United States Patent [19]

Ezumi et al.

[11] Patent Number: 4,951,647

[45] Date of Patent: Aug. 28, 1990

[54] ENGINE CONTROL APPARATUS

[75] Inventors: Koji Ezumi, Odawara; Masaaki Miyazaki, Himeji; Shoichi Washino, Amagasaki; Hajime Kako, Himeji, all of Japan

[73] Assignees: Mikuni Corporation; Mitsubishi Denki Kabushiki Kaisha, both of Tokyo, Japan

[21] Appl. No.: 347,626

[22] Filed: May 5, 1989

[30] Foreign Application Priority Data

May 6, 1988 [JP] Japan ..... 63-110045
May 6, 1988 [JP] Japan ..... 63-110046
May 6, 1988 [JP] Japan ..... 63-110047
May 6, 1988 [JP] Japan ..... 63-110048

[51] Int. Cl.[5] ..... F02D 41/04; F02D 41/26

[52] U.S. Cl. ..... 123/494; 123/480; 123/492

[58] Field of Search ..... 123/478, 480, 486, 488, 123/492, 493, 494; 364/431.05

[56] References Cited

U.S. PATENT DOCUMENTS 3,931,808 1/1976 Rachel ..... 123/488
4,499,881 2/1985 Takao ..... 123/494 X
4,751,909 6/1988 Otobe ..... 123/492
4,805,579 2/1989 Toshimitsu et al. ..... 123/492
4,814,997 3/1989 Matsumura et al. ..... 123/488 X

*Primary Examiner*—Willis R. Wolfe
*Attorney, Agent, or Firm*—Sughrue, Mion, Zinn, Macpeak and Seas

[57] ABSTRACT

An engine control apparatus comprises a throttle sensor, a pressure sensor for detecting a pressure in the intake manifold of an engine as a value of the absolute pressure, an engine revolution speed detector, a zone detector for detecting the fact that a signal value indicating a degree of opening of a throttle valve and a signal value indicating an engine revolution speed fall in a predetermined atmospheric pressure detection zone and a processing unit to calculate a value of atmospheric pressure by adding a set value to a signal of pressure upon detecting said values being in the detection zone. A timer may be provided to detect the fact that the signal values of the degree of opening of the throttle valve and the engine revolution speed are continuously in the atmospheric pressure detection zone for a predetermined time.

18 Claims, 11 Drawing Sheets

ENGINE CONTROL APPARATUS

BACKGROUND OF THE INVENTION

1. Field of the Invention

The present invention relates to an engine control apparatus capable of detecting an atmospheric pressure without using an atmospheric pressure sensor.

2. Discussion of Background

Heretofore, operational characteristic quantities for an engine were electronically controlled on the basis of parameters such as an engine revolution speed, a pressure in the intake manifold, a degree of opening of a throttle valve, an atmospheric pressure and so on. A pressure in the intake manifold contiguous to the intake air passage which is at the downstream side of a throttle valve which is operated in association with an accelerator pedal to limit a quantity of intake air to the engine is detected as a value of the absolute pressure by a pressure sensor. An atmospheric pressure is detected by an atmospheric pressure sensor provided separate from the pressure sensor.

Thus, the conventional engine control apparatus has a disadvantage of high manufacturing cost because the atmospheric pressure sensor is required in addition to the pressure sensor.

SUMMARY OF THE INVENTION

It is an object of the present invention to provide an engine control apparatus capable of detecting accurately an atmospheric pressure without using an atmospheric pressure sensor and manufactured at a low manufacturing cost.

In accordance with the present invention, there is provided an engine control apparatus which comprises a throttle valve sensor for detecting a degree of opening of a throttle valve for limiting a quantity of intake air to an engine, a pressure sensor for detecting a pressure in an air intake manifold, as a value of the absolute pressure, contiguous to an intake air passage at the downstream side of the throttle valve, an engine revolution speed detecting means for detecting a revolution speed of the engine, a zone detecting means which receives a signal on a degree of opening of the throttle valve from the throttle valve sensor and a signal on the engine revolution speed from the engine revolution speed detecting means so as to detect that the values of the signals fall in an atmospheric pressure detection zone which is determined by a relation of the engine revolution speed and the degree of opening of the throttle valve by which a pressure loss in the intake air passage is rendered to be a specified value or lower, and a processing unit which receives a detection signal from the zone detecting means to calculate an atmospheric pressure by adding a set value to the signal from the pressure sensor.

In accordance with the present invention, there is provided an engine control apparatus which comprises a throttle valve sensor for detecting a degree of opening of a throttle valve for limitting a quantity of intake air to an engine, a pressure sensor for detecting a pressure in an air intake manifold, as a value of the absolute pressure, contiguous to an intake air passage at the downstream side of the throttle valve, an engine revolution speed detecting means for detecting a revolution speed of the engine, a timer means which receives a signal on a degree of opening of the throttle valve from the throttle sensor and a signal on the engine revolution speed from the engine revolution speed detecting means so as to detect that a time period in which the signal values continuously fall in the atmospheric pressure detection zone, which is determined by the degree of opening of the throttle valve and the engine revolution speed by which a pressure loss in the intake air passage is rendered to be a specified value or less, reaches a predetermined value, and a processing unit which receives a detection signal from the timer means to calculate an atmospheric pressure by adding a set value to the signal from the pressure sensor.

In accordance with the present invention, there is provided an engine control apparatus which comprises a throttle valve sensor for detecting a degree of opening of a throttle valve for limitting a quantity of intake air to an engine, a pressure sensor for detecting a pressure in an air intake manifold, as a value of the absolute pressure, contiguous to an intake air passage at the downstream side of the throttle valve, an engine revolution speed detecting means for detecting a revolution speed of the engine, a fuel quantity controlling means for controlling a quantity of fuel to the engine depending on operational conditions of the engine, a timer means for detecting that a time period in which the signal values continuously fall in the atmospheric pressure detection zone, which is determined by the degree of opening of the throttle valve and the engine revolution speed by which a pressure loss in the intake air passage is rendered to be a specified value or less, reaches a predetermined value, and a processing unit which receives a detection signal from the timer means to calculate an atmospheric pressure by adding a set value to the signal of pressure from the pressure sensor, wherein the fuel quantity controlling means increases an amount of fuel when it detects enrich mode wherein the output of the pressure sensor is higher than a set level which is lower than the atmospheric pressure value by a predetermined value.

In accordance with the present invention, there is provided an engine control apparatus which comprises a throttle valve sensor for detecting a degree of opening of a throttle valve for limitting a quantity of a main stream of air to an engine, a switching means for opening and closing a by-pass conduit for by-passing the throttle valve, a pressure sensor for detecting a pressure in an intake manifold, as a value of the absolute pressure, contiguous to an air intake passage at the downstream side of the by-pass conduit, an engine revolution speed detecting means for detecting a revolution speed of the engine, a zone detecting means which receives a signal on a degree of opening of the throttle valve from the throttle sensor and a signal on the engine revolution speed from the engine revolution speed detecting means so as to detect that a time period in which the signal values continuously fall in the atmospheric pressure detection zone, by which a pressure loss in the intake air passage is rendered to be a specified value or less, reaches a predetermined value, a processing unit which receives a detection signal from the zone detecting means to calculate an atmospheric pressure value by adding a set value to the signal of pressure from the pressure sensor, and a control means for controlling the opening and closing operations of the switching means on the basis of comparison of the detected atmospheric pressure value with a previously determined value.

Figure 7A:
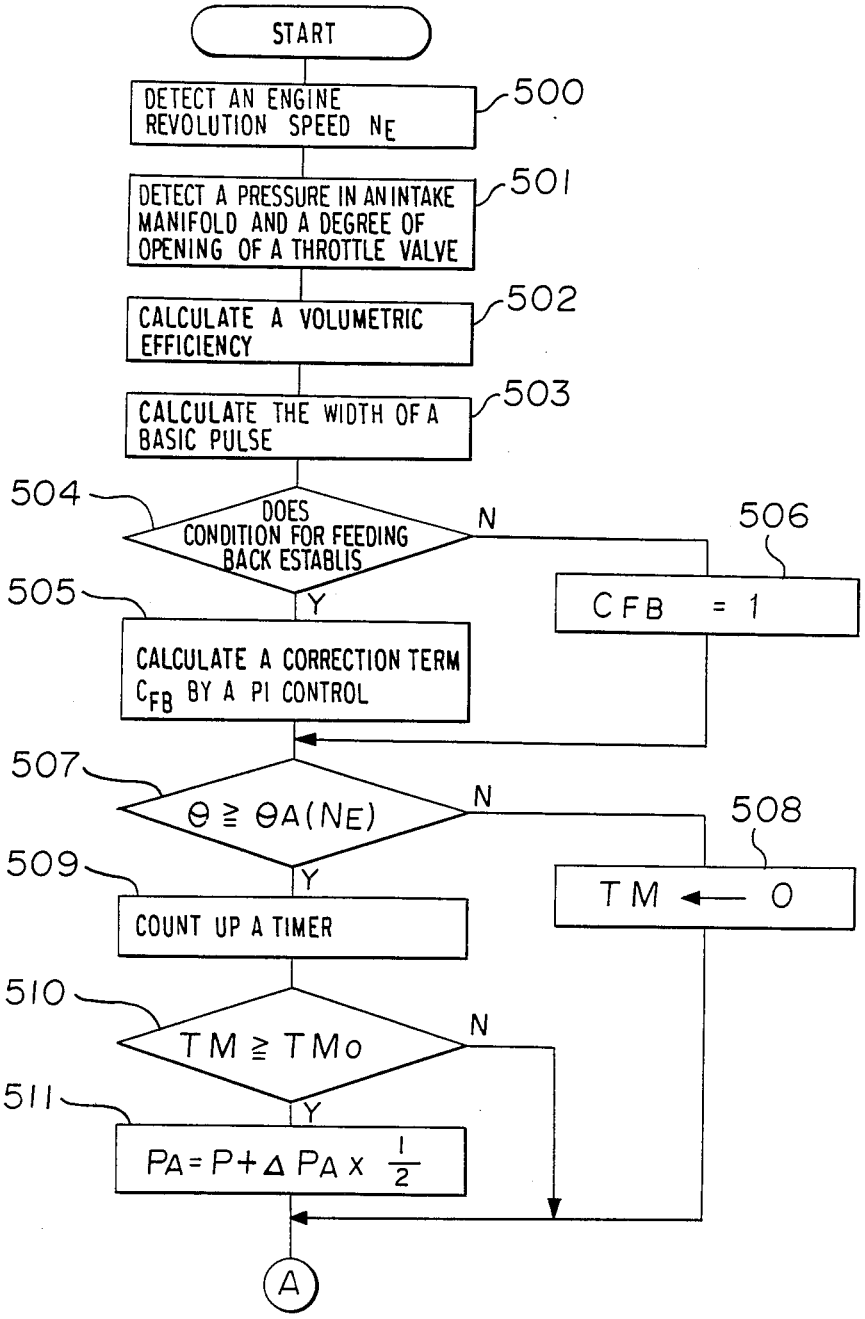
Figure 7B:
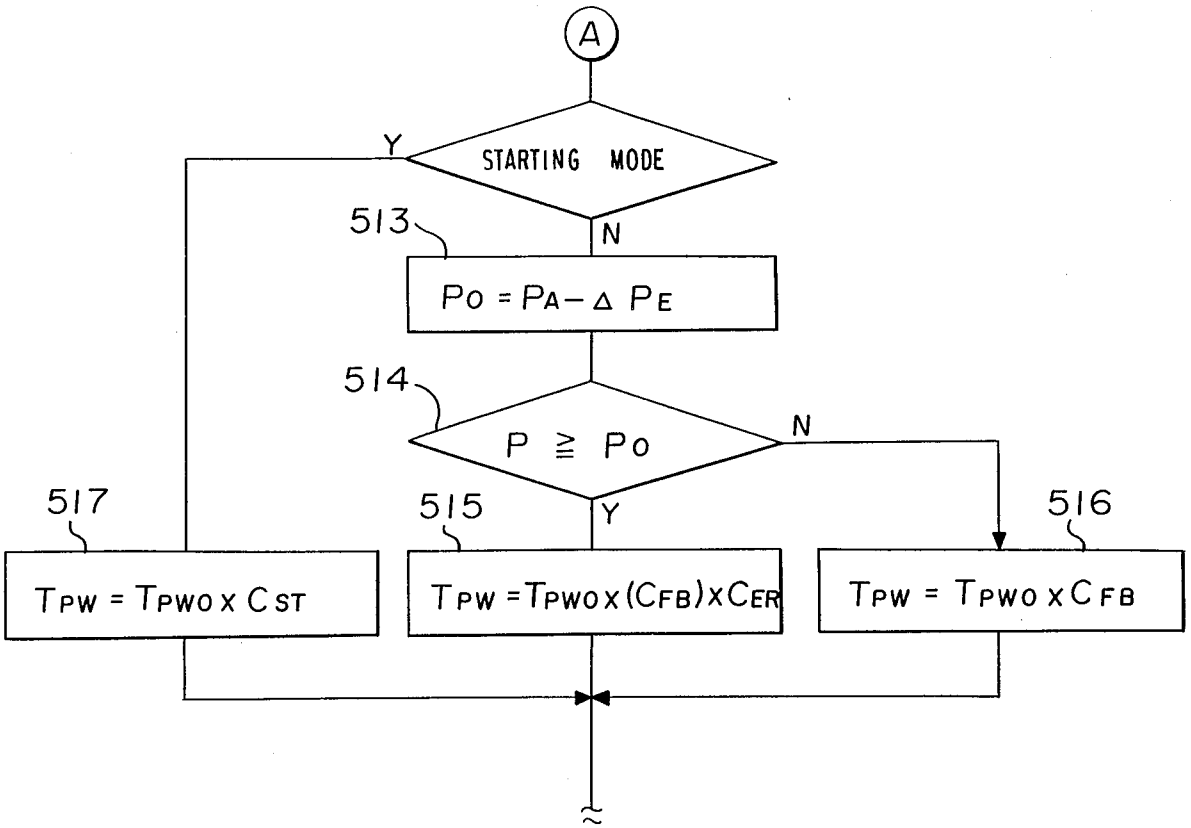
Figure 8:
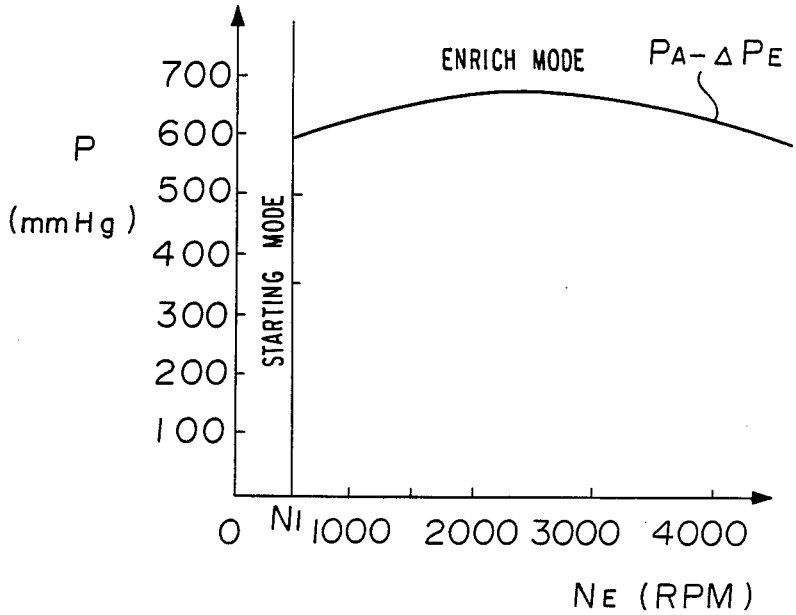
Figure 9:
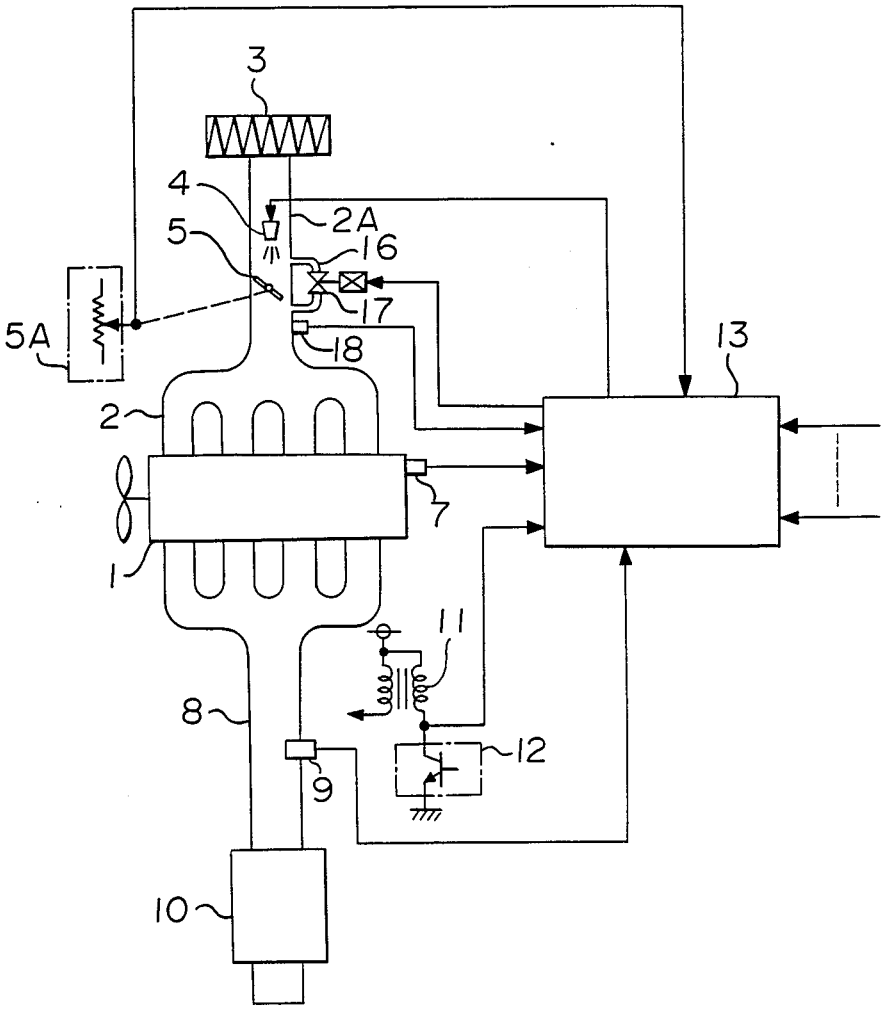
Figure 10A:
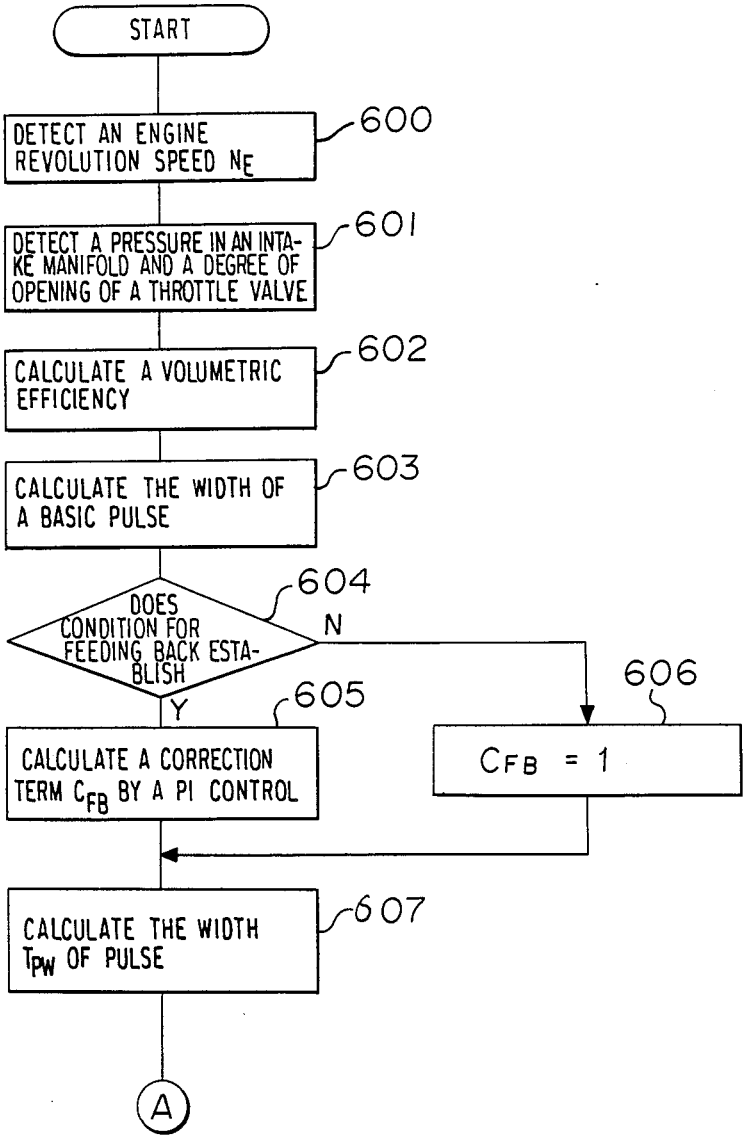
Figure 10B:
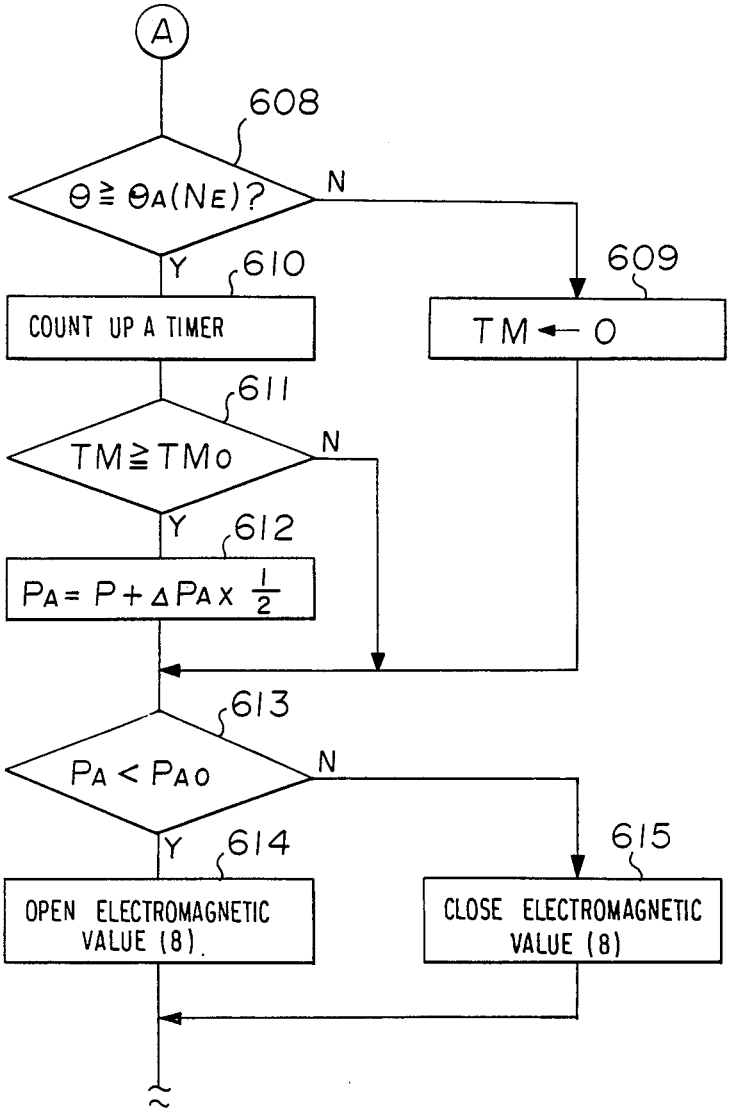

FIGS. 7*a* and 7*b* are a flow chart showing the operation of a CPU of the engine control apparatus which is applied for controlling fuel to an engine;

FIG. 8 is a diagram showing operational mode of an engine;

FIG. 9 is a diagram showing another embodiment of the engine control apparatus of the present invention; and FIGS. 10*a* and 10*b* are a flow chart showing the operation of a CPU of the engine control apparatus as shown in FIG. 9.

Preferred embodiments of the engine control apparatus of the present invention will be described with reference to the drawings.

Figure 1:
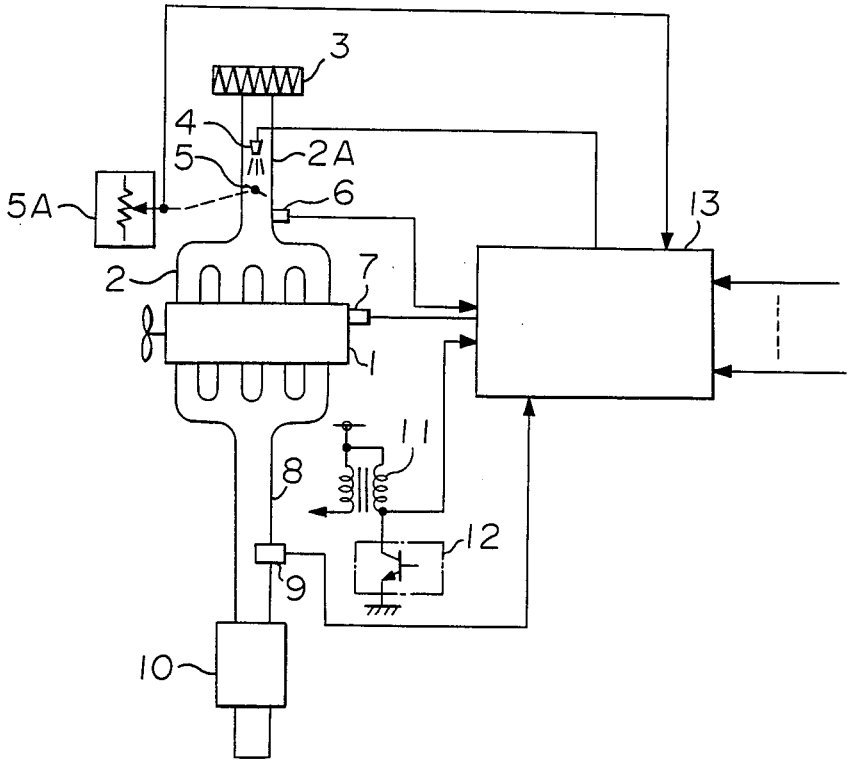
FIG. 1 is a diagram showing an embodiment of the engine control apparatus according to the present invention.

FIG. 1 shows an embodiment of the present invention. In FIG. 1, a reference numeral 1 designates an engine mounted on an automobile; a numeral 2 designates an intake manifold of the engine 1; a numeral 2A designates an intake air pipe main body connected to an upstream port of the intake manifold 2 and forming an intake air pipe along with the intake manifold 2; a numeral 3 designates an air cleaner placed at an inlet port of the intake air pipe main body 2A; and a numeral 4 designate an injector to supply fuel in the intake air pipe main body 2A.

A numeral 5 designates a throttle valve provided in the intake air pipe main body 2A to adjust a degree of opening for the intake air passage so that an amount of air to the engine 1 is controlled; a numeral 5A designates a throttle sensor of a type such as a potentio meter type which operates in association with the throttle valve and produces an analogue voltage in response to the degree of opening of the throttle valve 5; and a numeral 6 designates a pressure sensor which is provided in the intake air pipe main body 2A at the downstream side of the throttle valve 5 to detect a pressure P in the intake manifold as a value of the absolute pressure and produces a signal of pressure having a magnitude corresponding to a detected pressure.

A numeral 7 designates a cooling water temperature sensor to detect a temperature of cooling water WT for the engine 1; a numeral 8 designates an exhaust manifold in the engine 1; a numeral 9 designates an air/fuel ratio sensor to detect a concentration of oxygen in exhaust gas blowing in the exhaust manifold 8; a numeral 10 designates a three-way catalyst converter; a numeral 11 designates an ignition coil for supplying a high voltage to an ignition plug (not shown) of the engine 1; and a numeral 12 designates an igniter to turning on or off the ignition coil 11.

A numeral 13 designates a control device which is adapted to receive signals indicating various parameters obtained by detecting conditions in the engine 1 to perform various determination and calculations on the basis of the parameters, whereby a quantity of fuel to be injected and an atmospheric pressure value are calculated to thereby perform control of the engine.

Figure 2:
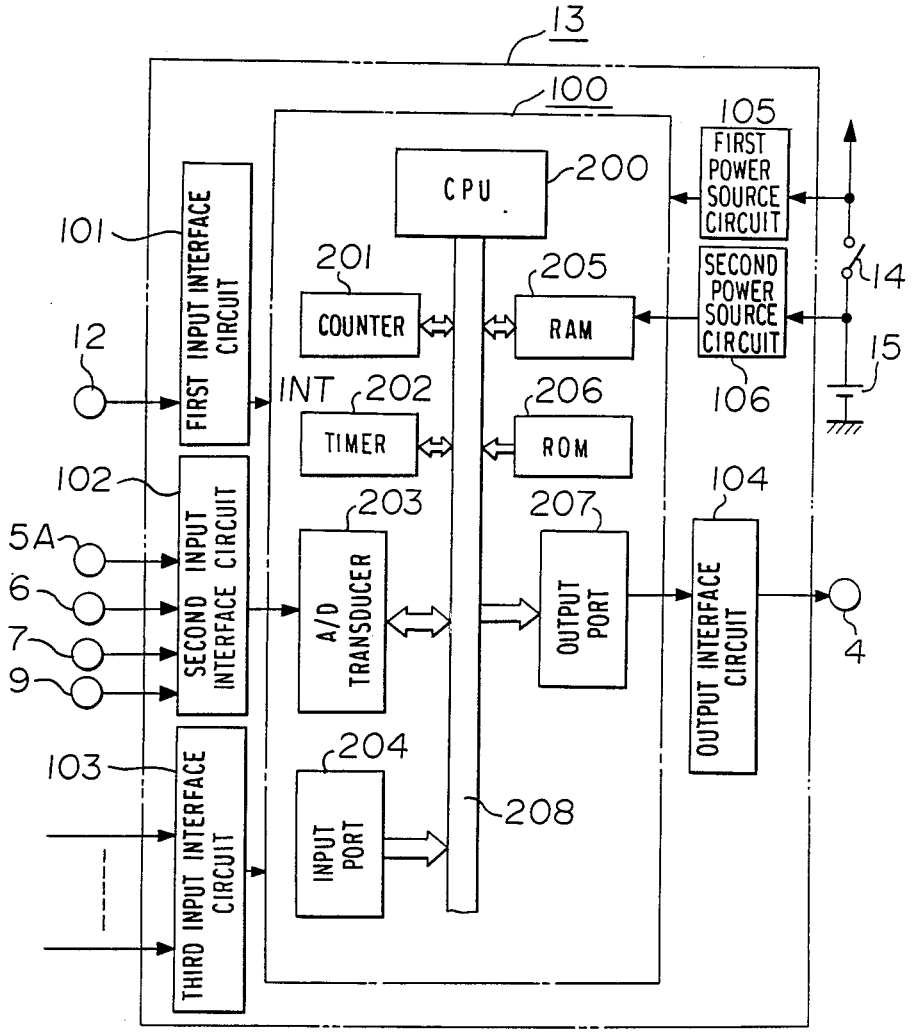
FIG. 2 is a block diagram showing an embodiment of the control device shown in FIG. 1.
Figure 3:
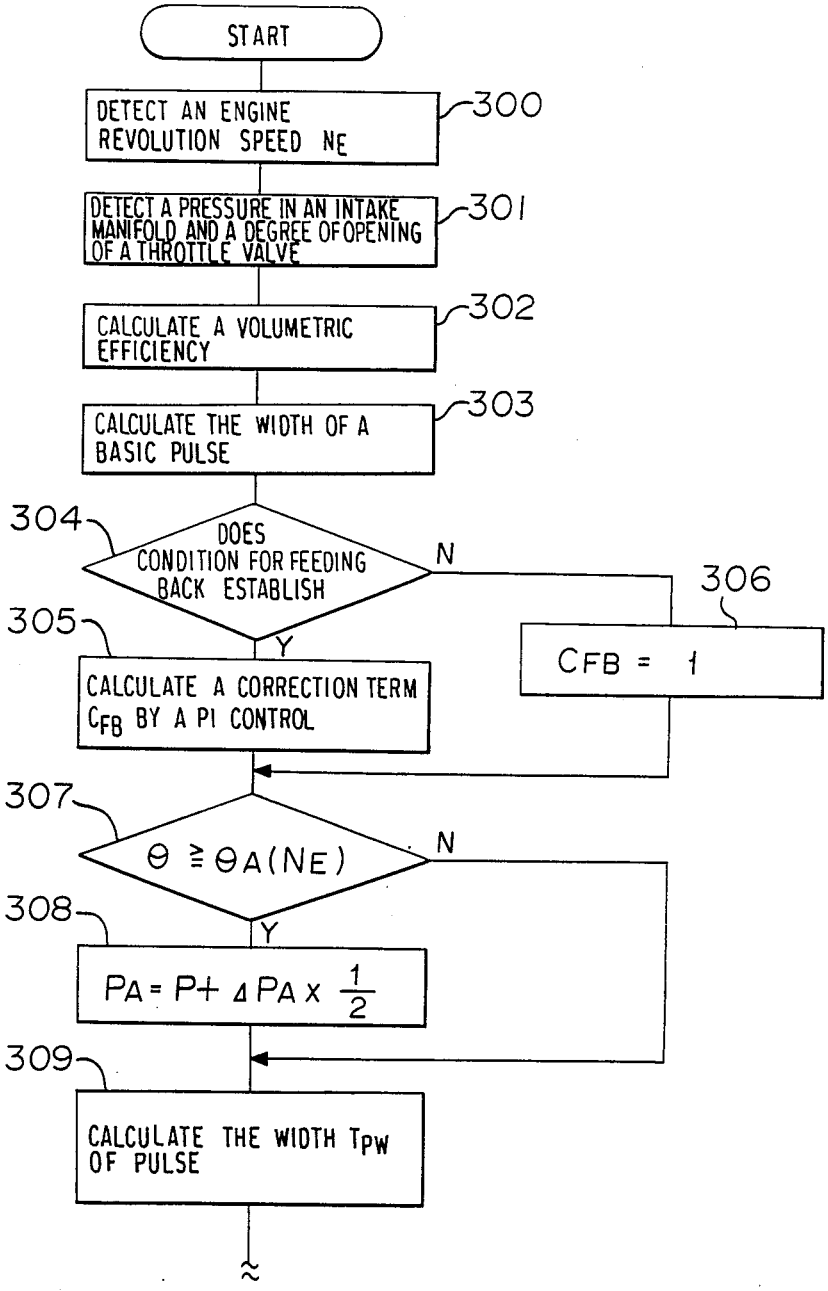
FIG. 3 is a flow chart showing the operation of a CPU in the control device.

The internal construction of the control device 13 will be described with reference to FIGS. 2 and 3. In FIG. 2, a numeral 100 designates a microcomputer which comprises a CPU 200 to execute a flow of steps as shown in FIG. 3, a counter 201, a timer 202 to measure a period of revolution of the engine 1, an A/D transducer 203 for transforming an analogue signal into a digital signal, an input port 204 to receive for transmission digital signals, a non-volatile RAM 205 which functions as a work memory, an ROM 206 which stores the flow of steps as shown in FIG. 3 in a form of program, as well as the lower limit value $\theta_A$ ($N_E$) of an atmospheric pressure detection zone (which will be described hereinafter) in relation of the engine revolution speed ($N_E$) to the degrees of opening of the throttle valve, and various data for calculations and determination such as set values for compensating a pressure loss (which will be described hereinafter), an output port 207 to generate a signal such as a signal of a fuel injection quantity obtained by calculation, and a common bus 208 for connecting the above-mentioned structural elements.

The control device 13 is provided with a first input interface circuit 101 which is connected to the junction of a primary side coil terminal of the ignition coil 11 and the collector of a switching transistor for the igniter 12, and supplies a signal for detecting, for instance, an engine revolution number to the microcomputer 100, a second input interface circuit 102 to input analogue output signals from the throttle sensor 5A, the pressure sensor 6, the cooling water sensor 7 and the air-fuel ratio sensor 9 to the A/D transducer 203, a third input interface circuit 103 to receive other various signals, an output interface circuit 104 for outputting a signal indicative of a quantity of fuel to be ejected which is output from the output port 207, to the injecter 4 as a pulse signal having a time width, a first power source circuit 105 which is connected to the positive side of a battery 15, whose negative terminal is grounded, through a key switch 14 to thereby feed power to the microcomputer 100, and a second power source circuit 106 connected to the positive side of the battery 15 to thereby supply power to the RAM 205.

Figure 4:
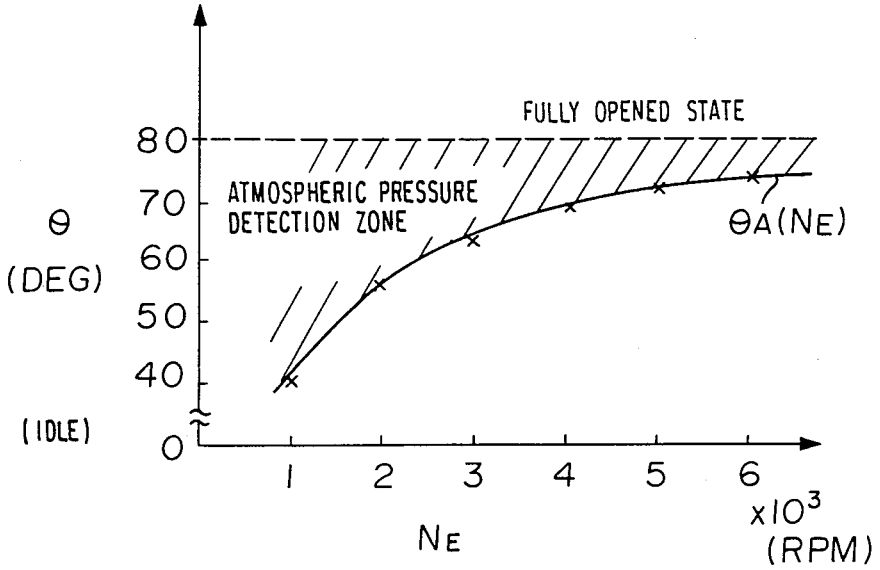
FIG. 4 is a diagram showing an atmospheric pressure detection zone.

FIG. 4 is a diagram showing by hatching a range of atmospheric pressure detection zone wherein the abscissa represents engine revolution speed $N_E$ and the ordinate represents throttle-opening degrees $\theta$. The lower limit values $\theta_A$ ($N_E$) of the atmospheric pressure detection zone are indicated in a relation of the degree of opening of the throttle valve to the engine revolution speed $N_E$. As the engine revolution speed $N_E$ increases, the degree of opening of the throttle valve $\theta$ takes greater values. The data of the lower limit values are previously stored in a form of map in the ROM 206 in a relation of the values of the degree of opening of the throttle valve corresponding to the engine revolution speed $N_E$. The atmospheric pressure detection zone lies between upper limit values obtained when the throttle valve 5 is in a fully opened state, for instance, when it is opened 80° and the lower limit values $\theta_A$ ($N_E$) of the atmospheric pressure detection zone. In such zone, pressure lOss becomes small. Namely, the pressure loss in the intake air passage at the downstream side of the throttle valve 5 is lower than $\Delta P_A$ (for instance, $\Delta P_A$ is 20 mmHg) as shown in FIG. 5.

Figure 5:
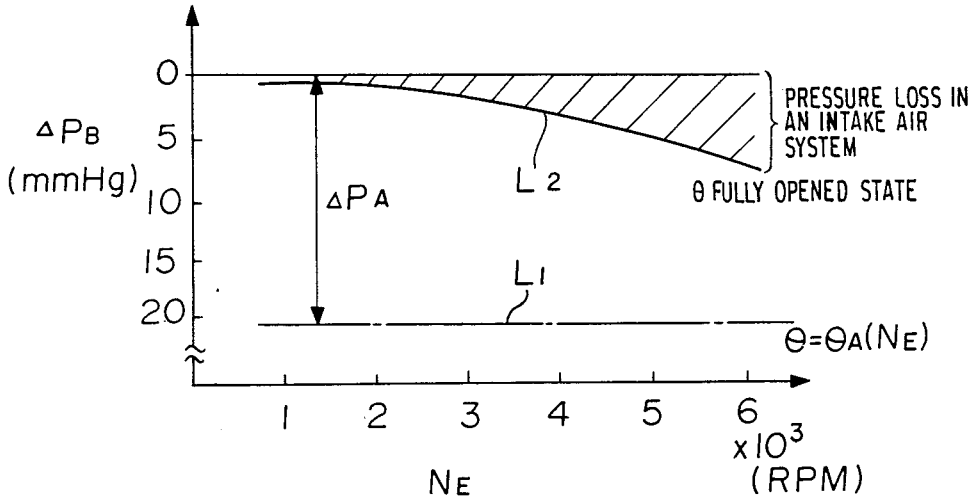
FIG. 5 is a diagram showing the relation of engine revolution speed and pressure loss in an air intake system.

In FIG. 5 showing pressure loss in the intake air system, the abscissa represents engine revolution speed $N_E$ and the ordinate represents pressure loss $\Delta P_B$ in the intake air system. When the pressure loss $\Delta P_B$ is 0, the pressure P in the intake manifold coincides with the atmospheric pressure. When a degree $\theta$ of opening of the throttle valve lies on the curve indicating the lower limit values $\theta_A$ ($N_E$) of the atmospheric pressure detection zone, the pressure loss can be represented by a linear line $L_1$, namely, $\Delta P_B = \Delta P_A$, i.e. the pressure loss is constant. The value of $\Delta P_A$ is previously stored in the ROM 206 as a set value ($\Delta P_A \times \frac{1}{2}$) for compensating the component of pressure loss in the intake air passage at the downstream side of the throttle valve 5. When the throttle valve is in a fully opened state, the pressure loss $\Delta P_B$ increases from a value of nearly zero, as the engine revolution speed $N_E$ increases to thereby closely come to the pressure loss $\Delta P_A$ as shown by a curved line $L_2$. When the throttle valve is Opened so as to correspond to the engine revolution speed in the atmospheric pressure detection zone, the values of the pressure loss lies between the linear line $L_1$ and the curved line $L_2$.

The operation executed by the CPU 200 in the microcomputer 100 will be described.

When the key switch 14 is turned on, a voltage is applied to the first power source circuit 105 by means of the battery 15. The first power source circuit 105 supplies a power of a fixed voltage such as 5V to the microcomputer 100, whereby the control device 13 is actuated. Then, a flow of an interruption routine as shown in FIG. 3 is executed for each predetermined time.

At Step 300, a revolution number $N_E$ of the engine 1 is calculated on the basis of the data measured by the timer 202 which measures the period of revolution of the engine, and the calculated value of the revolution number $N_E$ is stored in the RAM 205. The timer 202 measures a time from the last ignition to the present ignition, as a period of revolution of the engine, by receiving an ignition signal produced when the igniter 12 is changed from ON to OFF through the first input interface circuit 101. The measured value is stored in the RAM 205.

At Step 301, a signal of pressure indicative of a pressure P in the intake manifold is read from the pressure sensor 6 through the second input interface circuit 102 and the A/D transducer 203. Further, a signal of the degree $\theta$ of opening of the throttle valve is read by means of the throttle sensor 5A through the second input interface circuit 102 and the A/D transducer 203, and the values thus respectively read are stored in the RAM 205.

At Step 302, the volumetric efficiency $C_{EV}$ of the engine which is determined by the pressure P in the intake manifold and the engine revolution speed $N_E$ is calculated. Then, the width $T_{PWO}$ of a basic pulse of fuel injection quantity is calculated by using a formula $T_{PWO} = K\ (coefficient) \times P \times C_{EV}$ at Step 303. At Step 04, determination is made as to whether or not there is established condition for feeding-back an air-fuel ratio from the fact that whether or not the air-fuel ratio sensor 9 becomes active, namely, whether or not the output signal of the air-fuel ratio sensor 9 changes in a predetermined time, or the level of the temperature WT of cooling water detected by the cooling water temperature sensor 7 changes.

When the condition of the feed-back is established so that a control of the feed-back can be utilized at Step 304, a calculation of a feed-back correction term $C_{FB}$ in the fuel injection time is executed by using a PI control in response to the output of the air-fuel ratio sensor 9 at Step 305.

On the other hand, when the condition of the feed-back is not established, i.e. when a determination of open loop is made at Step 304, the correction term $C_{FB}$ is set to be 1 at Step 306. After the Steps 305 and 306, determination is made as to whether or not the value of the opening of the throttle valve given by a signal taken from the RAM 205 is higher than the lower limit value $\theta_A$ ($N_E$), which corresponds to the engine revolution speed $N_E$, of the atmospheric pressure detection zone obtained by a signal taken from the ROM 206. Namely, determination is made as to whether or not the value of the degree of opening of the throttle valve falls in the atmospheric pressure detection zone.

At Step 307, when $\theta \geqq \theta_A$ ($N_E$), namely the value of the degree $\theta$ of opening falls in the atmospheric pressure detection zone, then, Step 308 is taken. At Step 308, a value indicative of an atmospheric pressure $P_A$ which is determined by the pressure P in the intake manifold and the pressure loss $\Delta P_A$ at the lower limit value of the atmospheric pressure detection zone shown in FIG. 5, is calculated and thus obtained value is stored in the RAM 205. In the calculation, a formula of $P_A = P + \Delta P_A \times \frac{1}{2}$ is used wherein a value corresponding to P is taken from the RAM 205 and a set value corresponding to $\Delta P_A \times \frac{1}{2}$ is taken from ROM 206 respectively.

On the other hand, when $\theta < \theta_A$ ($N_E$), i.e. the value of the degree of opening is out of the atmospheric pressure detection zone at Step 307, or when the treatment at Step 308 has been finished, Step 309 is taken. At Step 309, the width $T_{PW}$ of the basic pulse of fuel injection quantity is calculated by multiplying the width $T_{PWO}$ of the basic pulse taken from the RAM 205 by the Correction term $C_{FB}$.

In the above-mentioned embodiment, the data of the lower limit values $\theta_A$ ($N_E$) of the atmospheric pressure detection zone may be obtained by using the engine revolution speed $N_E$ as a function. Further the pressure loss $\Delta P_A$ may be changed in response to the engine revolution speed $N_E$ without fixing the value, and the set value $\Delta P_A \times \frac{1}{2}$ may be obtained by using the engine revolution speed $N_E$ as a function.

Thus, in accordance with the above-mentioned embodiment of the present invention, when both a degree of opening of the throttle valve and an engine revolution speed fall in the atmospheric pressure detection zone, a value of atmospheric pressure is calculated by adding a set value to a signal of pressure from the pressure sensor for detecting the pressure of the intake manifold. Accordingly, the atmospheric pressure can be detected accurately without providing an atmospheric pressure sensor. Further, the manufacturing cost of the apparatus can be reduced.

A second embodiment of the engine control apparatus according to the present invention will be described.

Figure 6:
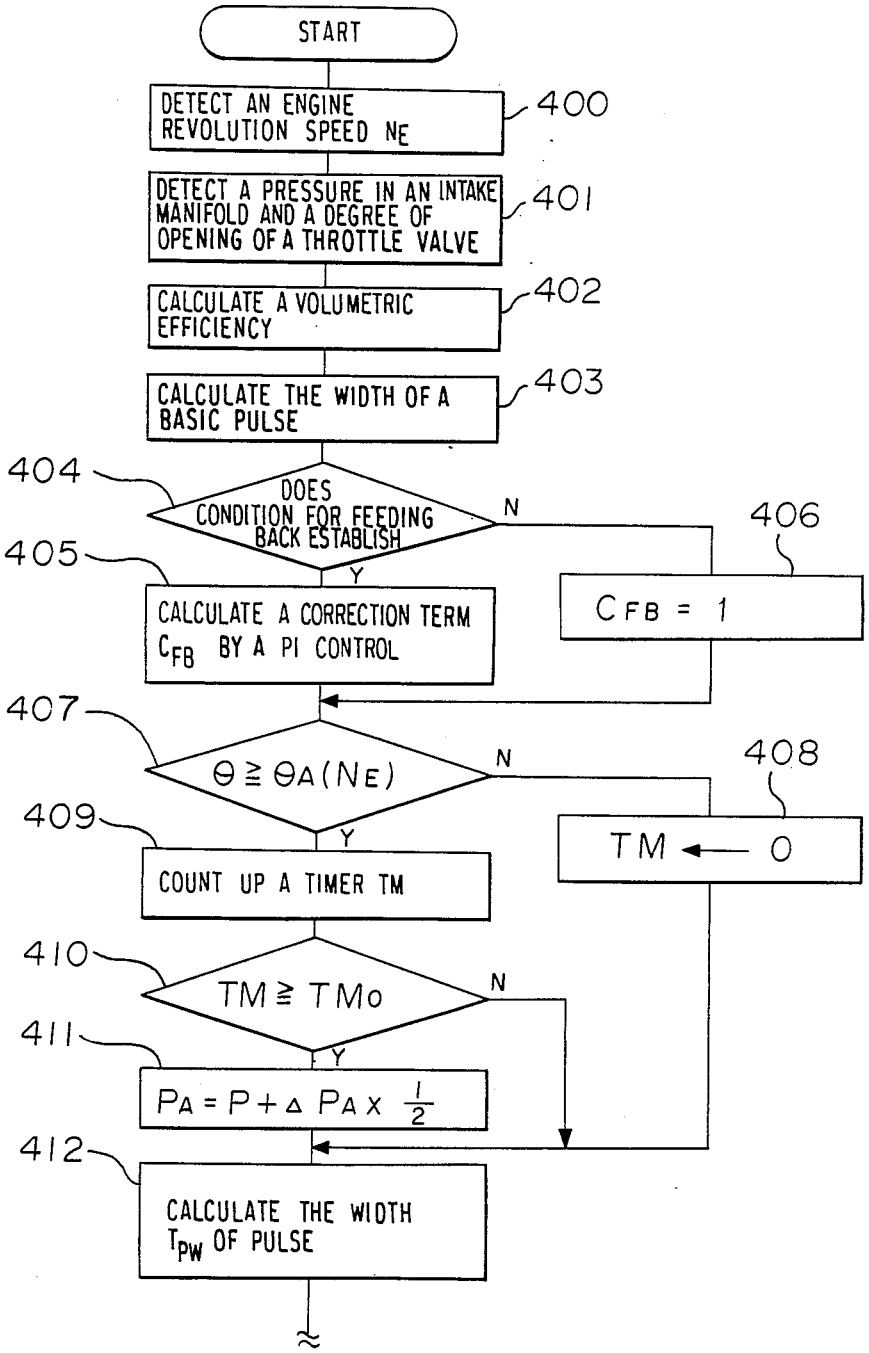
FIG. 6 is a flow chart showing the operation of a CPU for a second embodiment of the engine control apparatus according to the present invention.

The construction of the second embodiment of the present invention is the same as the first embodiment as shown in FIGS. 1 and 2 except that the function of an ROM indicated by a numeral 206 in FIG. 2 is different. Namely, the ROM 206 stores a flow of steps, in a form of program, as shown in FIG. 6, the data of the lower limit values $\theta_A$ ($N_E$) of the atmospheric pressure detection zone in a relation of the degree of opening of the throttle valve to the engine revolution speed ($N_E$) in the same manner as FIG. 4, and data for calculations and determination such as a set value for compensating the component of pressure loss in the same manner as that shown in FIG. 5.

The operation of the second embodiment of the engine control apparatus will be described with reference to a flow chart of FIG. 6 as well as FIGS. 1 and 2. In FIG. 6, description of Step 400 through Step 407 is the same as Step 300 through Step 307 explained in the first embodiment, and therefore, description is started from Step 408.

When $\theta < \theta_A$ ($N_E$), i.e. a degree of opening of the throttle valve is out of the atmospheric pressure detection zone at Step 407, then, a time TM in the counter 201 is reset to be 0 at Step 408.

On the other hand, when $\theta \geqq \theta_A$ ($N_E$), i.e. a degree $\theta$ of opening of the throttle valve corresponding to an engine revolution speed $N_E$ is in the atmospheric pressure detection zone at Step 407, the counter 201 is counted up for a predetermined time, and then, Step 410 is taken.

At Step 410, a time TM counted by the counter 201 is read, and determination is made as to whether or not the time TM is higher than a predetermined value $TM_0$ taken from the ROM 206, namely, whether or not a time period in which the signals of the degree $\theta$ of opening of the throttle valve and the engine revolution speed $N_E$ continuously fall in the atmospheric pressure detection zone reaches a predetermined time. When $TM \geqq TM_0$ which implies that the pressure P of the intake manifold in the atmospheric pressure detection zone is in a stable state, then, Step 411 is taken. At Step 411, a value of atmospheric pressure $P_A$, which is determined by the pressure P Of the intake manifold and the pressure loss $\Delta P_A$ at the lower limit of the atmospheric pressure detection zone, is calculated and thus obtained value is stored in the RAM 205. In the calculation, a formula $P_A = P + \Delta P_A \times \frac{1}{2}$ is used wherein a signal of the value of pressure p iS taken frOm the RAM 205 and a signal of the set value of $\Delta P_A \times \frac{1}{2}$ is taken from the ROM 206.

When $TM < TM_0$ at Step 410 or when the calculation of $P_A = P + \Delta P_A \times \frac{1}{2}$ is finished at Step 411, the width $T_{PW}$ of basic pulse of fuel injection quantity is calculated by multiplying the width $T_{PWO}$ of the basic pulse by a correction term $C_{FB}$ at Step 412.

In the second embodiment of the present invention, the fact that a time period in which a value of the pressure of intake manifold and a value of the engine revolution speed fall in the atmospheric pressure detection zone reaches a predetermined value is detected, and a value of atmospheric pressure is calculated by adding a set value to a signal of pressure from the pressure sensor in consideration that the pressure of the intake manifold becomes stable. Accordingly, an accurate atmospheric pressure can be detected, and the manufacturing cost of the apparatus can be reduced because it is unnecessary to use an atmospheric pressure sensor.

FIGS. 7 and 8 show a preferred embodiment of the engine control apparatus in which the second embodiment of the present invention is applied to control an amount of fuel. The fuel control apparatus for an internal combustion engine of the present invention is so adapted to detect that a pressure in the intake manifold is stable in the atmospheric pressure detection zone, by means of a timer means; to calculate an atmospheric pressure value by correcting the value of a signal of pressure from a pressure sensor by means of a processing unit on the basis of the pressure detected by the timer means, and to detect enrich mode by using the calculated atmospheric pressure value, whereby an amount of fuel to be supplied to the engine is controlled.

In FIG. *7a* and FIG. *7b* showing the operation of this embodiment, Steps 500–511 respectively correspond to Steps 400–411 in FIG. 6 which shows the operation of the above-mentioned second embodiment, and accordingly, description of these steps is omitted.

At Step 512, determination is made as to whether or not the engine 1 is in starting mode. When an engine revolution speed $N_E$ obtained by a signal of revolution speed taken from the RAM is lower than an engine revolution speed $N_1$ as shown in FIG. 8, the detected engine revolution speed falls in the starting mode. When it is not the case, an atmospheric pressure value representing an atmospheric pressure $P_A$ is read from the RAM 205, and a set value corresponding to a predetermined pressure $\Delta P_E$ is read from the ROM 206, whereby the lower limit pressure $P_O$ of the enrich mode as shown in FIG. 8 is calculated by using a formula $P = P_A - \Delta P_E$ to thereby obtain a threshold value of pressure of the enrich mode which corresponds to the lower limit pressure $P_O$ of the enrich mode, at Step 513. Then, determination is made as to whether or not a pressure P in the intake manifold taken from the RAM 205 is higher than the lower limit pressure $P_O$ of the enrich mode at Step 514, namely, whether or not the pressure P of the intake manifold is in enrich mode. When it falls in the enrich mode at Step 514, the width $T_{PW}$ of pulse of fuel injection calculated by multiplying all the items: of the basic pulse width $T_{PWO}$ and the feed-back correction term $C_{FB}$ read from the RAM 205 and an enrich coefficient $C_{ER}$ of the enrich mode read from the ROM 206, at Step 515. On the other hand, when determination of the starting mode is made at Step 512, the pulse width $T_{PW}$ of fuel injection is calculated by multiplying the basic pulse Width $T_{PWO}$ by a Correction term $C_{ST}$ of the starting mode at Step 517. When determination is so made as not in the enrich mode but operational mode wherein an air-fuel ratio feeding-back control can be conducted, the pulse width $T_{PW}$ of fuel injection is calculated by multiplying the basic pulse width $T_{PWO}$ read from the RAM 205 by a feed-back correction term $C_{FB}$ at Step 516. When either Step 515 or 516 is finished, the next Step is taken.

In the above-mentioned embodiment, the engine revolution speed is utilized for the determination of the starting mode. However, the level of the temperature WT of the cooling water detected by the cooling water temperature sensor 7 may be used for the determination of the starting mode in addition to the engine revolution speed.

Further, the predetermined pressure $\Delta P_E$ may be a fixed value or a variable dependent on the engine revolution speed.

The pressure loss $\Delta P_A$ may be in correspondence to the engine revolution speed, or the lower limit value $\theta_A$ ($N_E$) of the atmospheric pressure detection zone may be a function using the engine revolution speed as a variable.

Thus, in accordance with the embodiment of the present invention, the fact that the values of the engine revolution speed and the degree of opening of the throttle valve are continuously in the atmospheric pressure detection zone for a predetermined time is detected; an atmospheric pressure value is calculated by adding a set value to a pressure signal from the pressure sensor which detects a pressure in the intake manifold as a value of the absolute pressure; the level of the pressure signal is compared with a set value; and when the level of the pressure signal is higher than the set value which falls in the enrich mode, and amount of fuel to be supplied to the engine is increased. Accordingly, an engine control apparatus capable of controlling fuel supply with high accuracy can be obtained at a low manufacturing cost.

FIGS. 9 and 10 show a preferred embodiment of the engine control apparatus in which the second embodiment of the present invention is applied to control idling operations of the engine. Specifically, this embodiment is featurized by controlling opening and closing a by-pass conduit when the engine is in idling operations.

FIG. 9 is a diagram showing the construction of this embodiment wherein the same reference numerals as in FIG. 1 designate the same or corresponding parts, and therefore description of these parts is omitted.

A reference numeral 16 designates a by-pass conduit which connects the upstream side to the downstream side of the throttle valve 5 in the intake air pipe main body 2A; a numeral 17 designates an electromagnetic valve provided in the by-pass conduit 16 to open and close the same; and a numeral 18 designates a pressure sensor attached to the intake air pipe main body 2A at the downstream side of the by-pass conduit 16 whereby a pressure P in the intake manifold is detected as a value of the absolute pressure to thereby output a signal of pressure having the magnitude corresponding to a detected pressure.

A control device 13 is so adapted to receive various parameters of the engine to perform various determination and calculations by using previously stored or set data, and to control the injecter 4, the electromagnetic valve 17 and so on.

The construction of the circuit of the control device 13 is the same as that of the first embodiment as shown in FIG. 2 except that the microcomputer is provided with the CPU 200 for executing a flow as shown in FIG. 10, the ROM 206 which stores the flow in a form of program and other data for comparing, determining and calculating, and the output port 207 for outputting control signals for fuel to be injected, the electromagnetic valve 17 and so on.

The operation of this embodiment will be described.

Outer air is sucked into the engine 1 via the air cleaner 3, the intake air pipe main body 2A and the intake manifold 2 at an amount corresponding to the degree of opening of the throttle valve 5 along with fuel ejected from the injecter 4. Also, the air is supplied to the engine 1 via the by-pass conduit 16 when the electromagnetic valve 17 is actuated to open the by-pass conduit 16. After the air-suction process, well-known processes are conducted in the engine 1. For ignition, the igniter 12 is turned off so that a high voltage is supplied to an ignition plug (not shown) of the engine 1 through the ignition coil 11 to thereby effect ignition. Exhaust gas is passed through the exhaust manifold 8 during which it is purified by the three-way catalyst converter 10. By repeating the above-mentioned operations, the engine 1 is operated.

The operations of the control device 13 will be described with reference to the flow chart of FIG. 10. In FIG. 10, Steps 600–606 are the same as Steps 300–306, and accordingly description of these steps is omitted.

When either Step 605 or Step 606 is finished, the pulse width $T_{PW}$ for fuel injection is calculated by using a formula $T_{PW}=T_{PWO}\times C_{FB}$ at Step 607 and the calculated value is stored in the RAM 205. At Step 608, determination is made as to whether or not a degree $\theta$ of opening of the throttle valve represented by a signal on the degree of opening of the throttle valve taken from the RAM 205 is higher than the lower limit value $\theta_A$ ($N_E$) of the atmospheric pressure detection zone taken from the ROM 206, the lower limit value corresponding to the engine revolution speed $N_E$ represented by a signal of revolution number. Namely, determination is made as to whether or not the degree of opening $\theta$ of the throttle valve and the engine revolution speed $N_E$ which are detected, fall in the atmospheric pressure detection zone 1 surrounded by a hatched area in FIG. 4. When $\theta<\theta_A$ $N_E$), i.e. either or both values are out of the atmospheric pressure detection zone, a value of the counter 201, i.e. a time TM is reset to be 0 at Step 609. On the other hand, when $\theta\geqq\theta_A$ ($N_E$), i.e. either or both values are in the atmospheric pressure detection zone, then, Step 610 is taken.

At Step 610, the counter 201, i.e. the time TM is counted up. At Step 611, determination is made as to whether or not the time TM corresponds to a predetermined value $TM_0$. When $TM\geqq TM_0$, i.e. the value of the time TM is equal to or higher than the predetermined value, a detection value of atmospheric pressure $P_A$ is calculated by using a formula $P_A=P+\Delta P_A\times\frac{1}{2}$ at Step 612. For the calculation, a value representing the pressure P of the intake manifold is read from the RAM 205 and a value corresponding to $\Delta P_A\times\frac{1}{2}$ is read from the ROM 206.

After Step 609 has been taken, or when $TM<TM_0$ at Step 611, or when the operation of Step 612 has been finished, determination is made as to whether or not the atmospheric pressure $P_A$ obtained by calculation is lower than a predetermined pressure $P_{AO}$, i.e. the detected value representing the atmospheric pressure $P_A$ is lower than a set value at Step 613. When $P_A<P_{AO}$, namely, the calCulated atmospheric pressure $P_A$ is smaller than the predetermined pressure $P_{AO}$, this means the density of air in the atmosphere is thin, the electromagnetic valve 17 is opened through the output port 207 and the output interface circuit 104 to thereby open the by-pass conduit 16 at Step 614. On the other hand, when $P_A\geqq P_{AO}$, which means the density of air in the atmosphere is sufficient, the electromagnetic valve 17 is closed to thereby close the by-pass conduit 16 at Step 615. Then, the next step will be taken.

In the above-mentioned embodiment, opening and closing of the by-pass conduit 16 is effectively carried out in idling operation of the engine 1, and a degree of opening of the throttle valve 5 is determined with respect to the idling operation. Under such condition, the by-pass conduit 16 is opened and closed by the electromagnetic valve 17 on the basis of the conditions of the atmospheric pressure.

In the above-mentioned embodiment, the lower limit value $\theta_A$ ($N_E$) of the atmospheric pressure detection zone may be a function of the engine revolution speed $N_E$. Further, the lower limit value $\Delta P_A$ of pressure loss may be a variable so as to correspond to the engine revolution speed $N_E$.

Thus, in accordance with the embodiment of the present invention, when a value of the engine revolution speed and a value of the degree of opening of the throttle valve are in the specified atmospheric pressure detection zone for a predetermined time, a detection value of atmospheric pressure is calculated by adding a set value to a signal of pressure from the pressure sensor which detects a pressure in the intake manifold, whereby the by-pass conduit for by-passing the throttle valve is opened or closed depending on the fact that the detection value of atmospheric pressure is lower than a predetermined value. Accordingly, the construction of the engine control apparatus can be simple and the manufacturing cost can be reduced.

What is claimed is:

1. An engine control apparatus which comprises:

a throttle valve sensor for detecting a degree of opening of a throttle valve for limiting a quantity of intake air to an engine, a pressure sensor for detecting a pressure in an air intake manifold, as a value of the absolute pressure, contiguous to an intake air passage at a downstream side of said throttle valve, an engine revolution speed detecting means for detecting a revolution speed of the engine, a zone detecting means which receives a signal representing a degree of opening of the throttle valve ($\theta$) from said throttle valve sensor and a signal representing the engine revolution speed (Ne) from said engine revolution speed detecting means and detects when the values of said signals fall in an atmospheric pressure detection zone determined by a relation of the engine revolution speed and the degree of opening of the throttle valve at which a pressure loss in said intake air passage is at a specified value ($\Delta P_A$) or lower, and a processing unit which receives a detection signal from said zone detecting means and calculates an atmospheric pressure by adding a set value ($\Delta P_A/2$) to a signal representing pressure from said pressure sensor.

2. The engine control apparatus according to claim 1, wherein said atmospheric pressure detecting zone is defined by upper limit values obtained when the throttle valve is in a fully opened state and lower limit values determined by the degrees of opening of the throttle valve corresponding to the engine revolution speeds.

3. The engine control apparatus according to claim 2, wherein said lower limit values are previously stored in a memory device.

4. The engine control apparatus according to claim 1, wherein said set value is obtained by multiplying said specified value of pressure loss by a coefficient.

5. An engine control apparatus which comprises:

a throttle valve sensor for detecting a degree of opening of a throttle valve for limitting a quantity of intake air to an engine, a pressure sensor for detecting a pressure in an air intake manifold, as a value of the absolute pressure, contiguous to an intake air passage at the downstream side of said throttle valve, an engine revolution speed detecting means for detecting a revolution speed of the engine, a timer means which receives a signal on a degree of opening of the throttle valve from said throttle sensor and a signal on the engine revolution speed from said engine revolution speed detecting means so as to detect that a time period in which said signal values continuously fall in an atmospheric pressure detection zone, which is determined by said degree of opening of the throttle valve and said engine revolution speed by which a pressure loss in said intake air passage is rendered to be a specified value or less, reaches a predetermined value, and a processing unit which receives a detection signal from said timer means to calculate an atmospheric pressure by adding a set value to the signal of pressure from said pressure sensor.

6. The engine control apparatus according to claim 5, wherein said atmospheric pressure detecting zone is defined by upper limit values obtained when the throttle valve is in a fully opened state and the lower limit values determined by the degrees of opening of the throttle valve corresponding to the engine revolution speeds.

7. The engine control apparatus according to claim 6, wherein said lower limit values are previously stored in a memory device.

8. The engine control apparatus according to claim 5, wherein said set value is obtained by multiplying said specified value of pressure loss by a coefficient.

9. An engine control apparatus which comprises:

a throttle valve sensor for detecting a degree of opening of a throttle valve for limitting a quantity of intake air to an engine, a pressure sensor for detecting a pressure in an air intake manifold, as a value of the absolute pressure, contiguous to an intake air passage at the downstream side of said throttle valve, an engine revolution speed detecting means for detecting a revolution speed of the engine, a fuel quantity controlling means for controlling a quantity of fuel to said engine depending on operational conditions of the engine, a timer means for detecting that a time period in which said signal values continuously fall in an atmospheric pressure detection zone, which is determined by the degree of opening of the throttle valve and the engine revolution speed by which a pressure loss in said intake air passage is rendered to be a specified value or less, reaches a predetermined value, and a processing unit which receives a detection signal from said timer means to calculate an atmospheric pressure by adding a set value to the signal of pressure from said pressure sensor, wherein said fuel quantity controlling means increases an amount of fuel when it detects enrich mode wherein the output of said pressure sensor is higher than a set level which is lower than said atmospheric pressure value by a predetermined value.

10. The engine control apparatus according to claim 9, wherein said atmospheric pressure detecting zone is defined by upper limit values obtained when the throttle valve is in a fully opened state and the lower limit values determined by the degrees of opening of the throttle valve corresponding to the engine revolution speeds.

11. The engine control apparatus according to claim 10, wherein said lower limit values are previously stored in a memory device.

12. The engine control apparatus according to claim 9, wherein said set value is obtained by multiplying said specified value of pressure loss by a coefficient.

13. The engine control apparatus according to claim 9, wherein said enrich mode is determined when an engine revolution speed is a predetermined value or more.

14. An engine control apparatus which comprises:

a throttle valve sensor for detecting a degree of opening of a throttle valve for limitting a quantity of a main stream of air to an engine, a switching means for opening and closing a by-pass conduit for by-passing said throttle valve, a pressure sensor for detecting a pressure in an intake manifold, as a value of the absolute pressure, contiguous to an intake air passage at the downstream side of said by-pass conduit, an engine revolution speed detecting means for detecting a revolution speed of the engine, a zone detecting means which receives a signal on a degree of opening of the throttle valve from said throttle sensor and a signal on the engine revolution speed from said engine revolution speed detecting means so as to detect that a time period in which said signal values continuously fall in an atmospheric pressure detection zone, by which a pressure loss in said intake air passage is rendered to be a specified value or less, reaches a predetermined value, a processing unit which receives a detection signal from said zone detecting means to calculate an atmospheric pressure value by adding a set value to the signal of pressure from said pressure sensor, and a control means for controlling the opening and closing operations of said switching means on the basis of comparison of said detected atmospheric pressure value with a previously determined value.

15. The engine control apparatus according to claim 14, wherein said pressure loss of the intake air passage is measured at the downstream side of said by-pass conduit.

16. The engine control apparatus according to claim 14, wherein said atmospheric pressure detecting zone is defined by upper limit values obtained when the throttle valve is in a fully opened state and the lower limit values determined by the degrees of opening of the throttle valve corresponding to the engine revolution speeds.

17. The engine control apparatus according to claim 16, wherein said lower limit values are previously stored in a memory device.

18. The engine control apparatus according to claim 14, wherein said set value is obtained by multiplying said specified value of pressure loss by a coefficient.

* * * * *